United States Patent [19]

Perron

[11] 4,352,703

[45] Oct. 5, 1982

[54] FREE-SPINNING EMBOSSERS

[75] Inventor: Reginald F. Perron, Chambly, Canada

[73] Assignee: Hubscher Ribbon Corporation Limited, Montreal, Canada

[21] Appl. No.: 194,526

[22] Filed: Oct. 6, 1980

[51] Int. Cl.[3] ..... D03D 47/50

[52] U.S. Cl. ..... 156/88; 156/251; 156/515

[58] Field of Search ..... 156/88, 515, 251

[56] References Cited

U.S. PATENT DOCUMENTS 567,948 9/1896 Bracher ..... 156/88 X 3,367,810 2/1968 Wasserstein ..... 156/88

*Primary Examiner*—John P. McIntosh

*Attorney, Agent, or Firm*—Robert F. Delbridge; Arne I. Fors

[57] ABSTRACT

Ribbons with embossed side edges are produced from a length of thermoplastic material by pulling the material through a cutting station having side-by-side circular knives mounted for rotation about an axis substantially parallel to the plane of the material at the cutting station and substantially perpendicular to the direction of travel of the material through the cutting station. Each circular knife has a peripheral cutting edge and the knives are drivingly rotated and heated while the material is being pulled through the cutting station to cause the cutting knives to cut the material into a series of ribbons. Heated circular embossing members mounted on opposite sides of each circular knife are freely rotatable relative to the associated circular knife so that they are rotated by contact with the material and emboss the side edges of the ribbons.

7 Claims, 3 Drawing Figures

FREE-SPINNING EMBOSSERS

This invention relates to the manufacture of ribbons of synthetic thermoplastic material. Such ribbons are usually produced from a length of synthetic thermoplastic material by pulling the material through a cutting station having a plurality of side-by-side heated circular knives mounted for rotation about an axis parallel to the plane of the material and perpendicular to the direction of travel of the material through the cutting station. Each knife has a peripheral cutting edge, and the knives are drivingly rotated while the material is being pulled through the cutting station to cause the heated cutting knives to cut the material into a series of ribbons.

In order to give the side edges of the ribbons an improved appearance, the side edges may have a pattern embossed thereon, and the cutting knives are consequently provided with peripheral heated embossing surfaces adjacent the cutting edges so that an embossed pattern is produced on the side edges of the ribbons as the ribbons are being cut.

If the synthetic thermoplastic material is woven material, each heated cutting knife fuses the side edges of the ribbons while the material is being cut to form fused side edges which do not unravel.

With the known arrangements described above, the side edges of the ribbons are frequently wrinkled by the heated embossing surfaces of the cutting knives. It is also known to cut the material into ribbons and if necessary fuse the side edges in one operation, with the embossing being carried in another operation, but the disadvantage of having to carry out two such separate operations is selfevident. It is therefore an object of the invention to provide an improved method of producing ribbons from thermoplastic material which overcomes these disadvantages.

According to the present invention, the embossing is effected by circular heated embossing members located on opposite sides of each heated circular knife and which are freely rotatable relative thereto. It has been found that, with such an arrangement, satisfactory cutting and embossing and if necessary fusing can be achieved without causing the side edges of the ribbons to wrinkle.

Each circular knife may have an annular shoulder radially inwardly of the cutting edge on each side thereof, with a circular embossing member being mounted on each annular shoulder and being freely rotatable relative thereto.

Advantageously, the cutting knives are drivingly rotated at a speed slightly faster than the speed at which the material is pulled through the cutting station.

One embodiment of the invention will now be described, by way of example, with reference to the accompanying drawings, of which:

Figure 1:
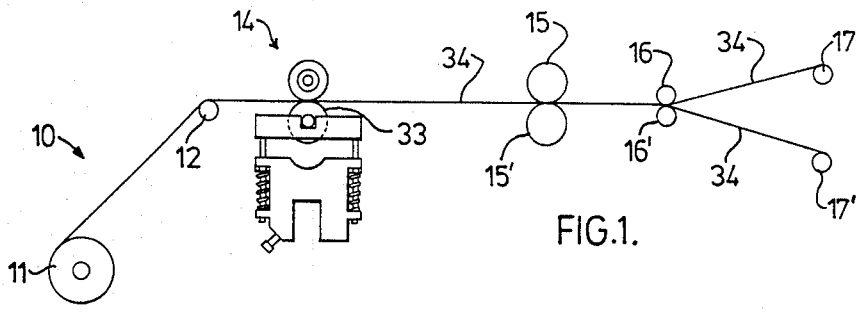
FIG. 1 is a diagrammatic view of a ribbon producing operation.
Figure 2:
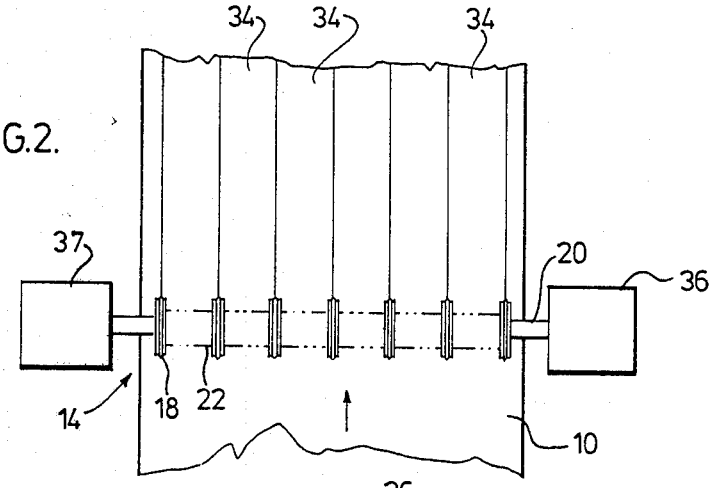
FIG. 2 is a plan view of the cutting station showing the material being cut into ribbons.
Figure 3:
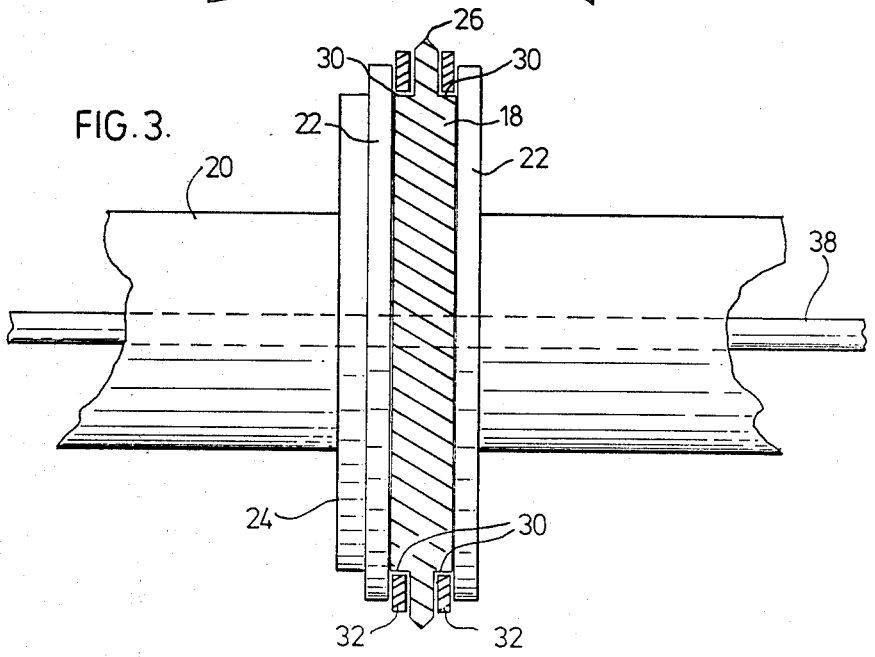
FIG. 3 is a front view of a cutting knife and associated embossing members and spacers.

Referring to the drawings, ribbons are produced from a length of woven synthetic thermoplastic material 10 by pulling the material from a roll 11 over an idler 12 and through a cutting station 14 by rotation of a pair of driven rollers 15, 15'. The resultant ribbons pass between idlers 16, 16' and are wound on driven rolls 17, 17'.

At the cutting station 14, a series of circular metal cutting knives 18 are mounted on a shaft 20 with a sliding fit for rotation about an axis parallel to the plane of the material 10 and perpendicular to the direction of travel of the material 10 through the cutting station. Adjacent cutting knives are separated by spacers 22 which are also rotatably mounted with a sliding fit on the shaft 20. At each end of the shaft 20, a nut 24 in screw-threaded engagement with the shaft 20, can be rotated to force the circular knives 18 and spacers 22 together against one another so that rotation of the shaft 20 causes rotation of the circular knives 18 and spacers 22.

Each circular knife 18 has a peripheral cutting edge 26 and an annular shoulder 30 radially inwardly of the cutting edge 26 on each side thereof. A pair of annular metal embossing members 32 are mounted on the annular shoulders 30 and are freely rotatable relative thereto. The width of each annular embossing member 32 is slightly less than that of the associated annular shoulder 30 so that the spacers 22 do not engage the embossing members 32 when the nut 24 is tightened to urge the spacers 22 and cutting knives together. Also, the diameter of the embossing members 32 is slightly less than that of the cutting edge 26.

The material 10 contacts each cutting knife 18 and associated embossing members 32 and is resiliently urged upwardly into engagement with the cutting knives 18 by a respective one of a series of resiliently mounted idlers 33. The idlers 33 do not contact the embossing members 32.

The shaft 20 is mounted at opposite ends in journal boxes 36, 37, one of which contains means to rotate the shaft 20. The shaft 20 contains an electrical heating element 38 which heats the shaft 20, with heat being conducted to each cutting knife 18 and associated embossing members 32, such that the temperature of the cutting edges 26 and the embossing surfaces of the embossing members 32 is about 750° F. (400° C.).

In use, the material 10 is pulled through the cutting station 14 at a predetermined speed by rotation of the driven rollers 15, 15'. The cutting knives 18 and embossing members 32 are heated as previously described, and the shaft 20 is rotated to rotate the cutting knives 18, thereby cutting the material 10 into ribbons 34. The shaft 20 is rotated at such speed that the cutting edges 26 travel at a slightly higher speed than the material 10 to obtain an improved cut. At the same time as the cutting takes place, the heated cutting knives 18 fuse the woven material along the side edges of the ribbon 34 to prevent the side edges from unravelling.

Also, while the cutting and fusing is taking place, an embossed pattern is imparted to the side edges of the ribbons by the heated embossing members 32. Since each embossing member 32 is freely rotatable relative to the associated circular knife 18, the embossing members 32 rotate at a speed defined by the passage of the material 10, not by the speed of rotation of the circular knives 18. Thus, the cutting edges 26 can be drivingly rotated at an optimum speed, and the embossing members 32 are free to rotate at a speed dictated by the passage of the material thereover. The embossing members 32 therefore do not create any substantial drag on the material and hence do not cause the side edges of the ribbons to wrinkle.

The embossing members may be utilized to apply any suitable pattern to the side edges of the ribbons, for example designs and/or lettering.

Another advantage of the present invention is that it is possible to drive the shaft 20 and rollers 15, 15' by means of a single motor, whereas two motors were necessary with the known method in which the embossing surfaces were provided on the circular knives.

Other embodiments of the invention will be readily apparent to a person skilled in the art, the scope of the invention being defined in the appended claims.

What I claim as new and desire to protect by Letters Patent of the United States is:

1. A method of producing ribbons with embossed side edges from a length of thermoplastic material, comprising pulling said length of material through a cutting station having a plurality of side-by-side circular knives mounted for rotation about an axis substantially parallel to the plane of the material at the cutting station and substantially perpendicular to the direction of travel of the material through the cutting station, each circular knife having a peripheral cutting edge, drivingly rotating and heating the circular knives while the material is being pulled through the cutting station to cause the cutting knives to cut the material into a series of ribbons, and providing heated circular embossing members on opposite sides of each circular knife which are freely rotatable relative to the associated circular knife to cause the embossing members to be rotated by contact with the material and to emboss the side edges of the ribbons.

2. A method according to claim 1 wherein each circular knife has an annular shoulder radially inwardly of the cutting edge on each side thereof, and a circular embossing member is mounted on each annular shoulder and is freely rotatable relative thereto.

3. A method according to claim 1 wherein the material is woven material and the cutting knives fuse the side edges of the idlers while the knives are cutting the material into ribbons.

4. A method according to claim 1 wherein the cutting knives are drivingly rotated at a speed slightly faster than the speed at which the material is pulled through the cutting station.

5. Apparatus for producing ribbons with embossed side edges from a length of thermoplastic material, the apparatus comprising a cutting station and means for pulling the thermoplastic material through the cutting station, said cutting station having a plurality of side-by-side cutting knives mounted for rotation about an axis substantially parallel to the plane of the material at the cutting station and substantially perpendicular to the direction of travel of the material through the cutting station, each knife having a peripheral cutting edge, means for drivingly rotating the circular knives to cause the material to be cut into ribbons by the cutting edges as the material is pulled through the cutting station, circular embossing members on opposite sides of each circular knife, and means for heating the cutting knives and embossing members, each embossing member being freely rotatable relative to the associated circular knife and engageable and rotatable by contact with the material as it passes through the cutting station to cause the embossing member to emboss the respective side edge of a ribbon.

6. Apparatus according to claim 5 wherein each circular knife has an annular shoulder radially inwardly of the cutting edge on each side thereof, and a circular embossing member is mounted on each annular shoulder and is freely rotatable relative thereto.

7. Apparatus according to claim 5 including means for drivingly rotating the cutting knives at a speed slightly faster than the speed at which the material is pulled through the cutting station.

* * * * *